United States Patent [19]

Jaggi et al.

[11] 4,019,544

[45] Apr. 26, 1977

[54] APPARATUS FOR FORMING A CONTINUOUS WIRE INTO A MAT

[75] Inventors: Hans Jäggi, Wangen; Ernesto Lehmann, Neuhausen; Hugo Rechsteiner, Schaffhausen, all of Switzerland

[73] Assignee: Georg Fischer Aktiengesellschaft, Schaffhausen, Switzerland

[22] Filed: Oct. 2, 1975

[21] Appl. No.: 618,932

[30] Foreign Application Priority Data

Oct. 9, 1974 Switzerland ..... 13547/74

[52] U.S. Cl. ..... 140/112; 219/56; 72/DIG. 16

[51] Int. Cl.[2] ..... B21F 27/10

[58] Field of Search ..... 140/3, 71 R, 112, 105; 219/56; 72/DIG. 16

[56] References Cited

UNITED STATES PATENTS

| | | | |
|---|---|---|---|
| 3,369,575 | 2/1968 | Rosler | 140/112 |
| 3,722,777 | 3/1973 | Ziemek et al. | 140/112 |

FOREIGN PATENTS OR APPLICATIONS

| | | | |
|---|---|---|---|
| 185,205 | 7/1955 | Austria | 140/3 R |

*Primary Examiner*—Lowell A. Larson
*Attorney, Agent, or Firm*—Toren, McGeady and Stanger

[57] ABSTRACT

In forming a mat, a continuous length of wire is fed between a winding plate and a pair of laterally spaced parallel spindles located closely above the plate. The winding plate is adjustable relative to the spindles so that the wire forming the mat can be held gently between the spindles and the plate. A feed member is pivotally mounted for supplying the wire in a continuous alternating manner first to one spindle and then to the other. Each spindle has a helically formed wire guide followed by a screw thread. The wire fed to the spindles is directed into the screw threads by the wire guide. The spindles are rotated in opposite directions to obtain the desired feeding action. The mat is built up from a plurality of juxtaposed wire sections connected at their opposite ends by return bends. Welding members are movably positionable relative to the mat being formed to provide welding of the wire sections together on both sides of the mat.

15 Claims, 6 Drawing Figures

APPARATUS FOR FORMING A CONTINUOUS WIRE INTO A MAT

SUMMARY OF THE INVENTION

The present invention is directed to an apparatus and forming a continuous wire, particularly a plastic-coated wire, into a mat with juxtaposed wire sections folded back and forth against one another with the wire sections connected by return bends.

Such mats are suitable, for example, as heating wire mats for force-locked and sealed connection of molded saddle pieces consisting of a thermoplastic material with a main line, where one heating mat is arranged between the saddle piece and the main line and is fused with the other two parts by supplying electrical energy. However, the manufacture of a saddle piece with an embedded or inserted welding wire is rather elaborate.

Furthermore, it is possible to place a heating wire on a molded centering piece of weldable plastic with the mat on the inner circumference of the centering piece so that it bears in the assembled condition approximately on the entire inner circumference of the centering piece as well as on the outer circumference of the main line. If such an assembly can be produced satisfactorily, it meets all of the requirements of simple assembly, tight bearing on the two parts to be welded together, as well as a qualitatively stable tight joint.

The present invention concerns an apparatus for the manufacture of mats of the above-mentioned type in such a way that the wire mats are adapted in width to the intended use and can be produced economically as a continuous belt with the closely arranged wire sections of the mat joined with one another.

In accordance with the present invention, the mat is formed by arranging a pair of laterally spaced parallel spindles above a winding plate with a pivotally mounted wire feed member movable between the spindles for feeding a wire between the spindles and the winding plate.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
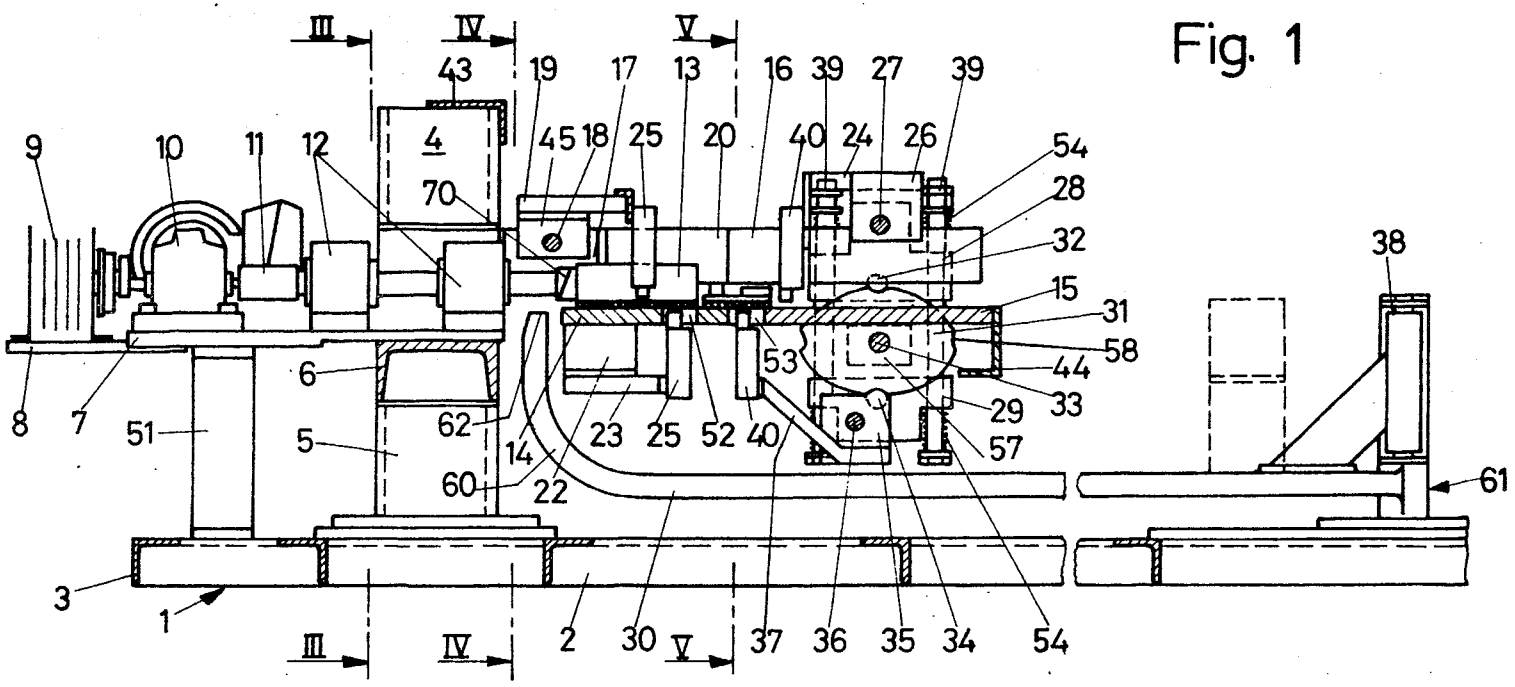
FIG. 1 is side view, partly in section, of an apparatus for manufacturing heating wire mats, embodying the present invention.

In the drawing an apparatus is shown for forming wire mats and it includes a horizontally arranged frame 1 consisting of longitudinal members 2 and cross members 3. A supporting frame 4 is secured to and extends upwardly from the frame 1 and includes two vertically extending lateral supports 5, 5′ and a horizontally arranged cross member 6 extending between the lateral supports.

Figure 2:
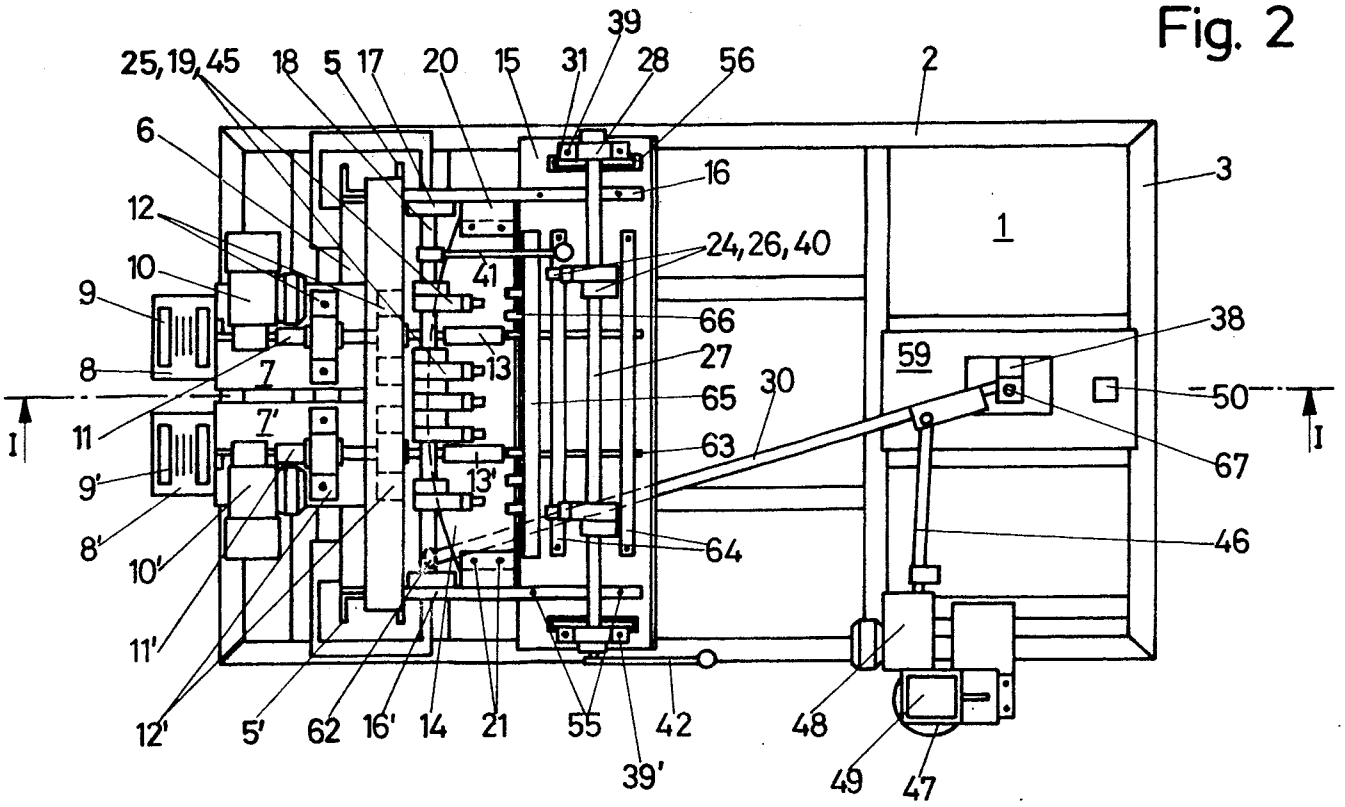
FIG. 2 is a top view of the apparatus illustrated in FIG. 1, but on a reduced scale.

As shown in FIGS. 1 and 2, two motor plates 7, 7′ are supported at one end on the cross member 6 and extend outwardly from the cross member. The two plates 7, 7′ are spaced laterally from one another and each supports a geared motor 10, 10′. A pair of bearing blocks 12, 12′ is arranged on each of the motor plates in spaced relation. A spindle 13, 13′ is supported in each pair of bearing blocks 12, 12′ and a coupling 11, 11′ connects each spindle to its corresponding geared motor. The spindles 13, 13′ extend in the opposite direction from the supporting frame 4 from the motor plates 7, 7′. Each spindle has a helically shaped wire guide 70, 70′ adjacent the supporting frame 4 with a screw thread 71, 71′ extending along the spindle from the wire guide. The screw thread 70, 71′ has a pitch which corresponds substantially to the wire diameter, note FIG. 6, while the helical wire guide which extends over half of the spindle circumference has a pitch which is umch greater than that of the screw thread.

A plate 8, 8′ is secured to each of the motor plate 7, 7′ and a program transmitter 9, 9′ is positioned on each of the plates. The transmitters 9, 9′ alternately actuate the geared motor 10, 10′ by pulses and, accordingly, drive the associated spindles 13, 13′. Beneath the motor plate 7, 7′ and spaced from the supporting frame 4, is another supporting frame 51 mounted on the frame 1 and provided with adjusting means, not shown, so that any axial differences between the driving elements and the corresponding spindles 13, 13′ can be compensated.

Figure 3:
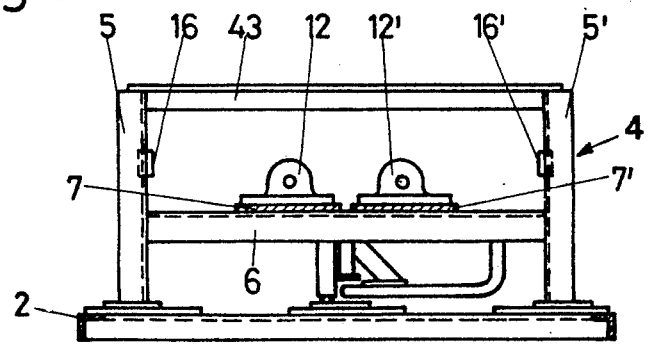
FIG. 3 is a sectional view taken along the line III—III in FIG. 1 and shown on a reduced scale.
Figure 4:
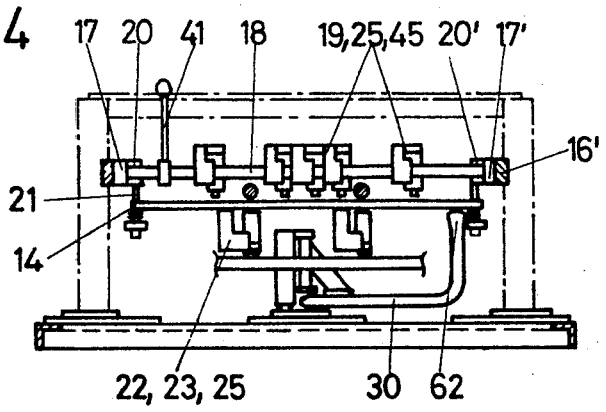
FIG. 4 is a sectional view taken along the line IV—IV of FIG. 1 and shown on a reduced scale.

In FIGS. 3 and 4 the apparatus is shown in section, and in FIG. 3 the supporting frame 4 along with the motor plate 7, 7′ and bearing blocks 12, 12′ can be seen supported on the cross member 6 which is connected to the two vertical lateral supports 5, 5′. In addition, a cantilever arm 16, 16′ is secured to each of the lateral supports 5, 5′ and, in turn, as can be seen in FIG. 4, supports lateral bearings 17, 17′ and suspensions 20, 20′. The cantilever arms 16, 16′ extend horizontally from the supporting frame 4 on the opposite side thereof from the geared motors 10, 10′.

An axle 18 is rotatably mounted in and extends between the bearing 17, 17′. Axially adjustable and lockable holders 45 are connected to the axle 18 by a key, not shown. A swivel arm 19, note FIG. 1, is mounted on each holder and supports a top welding pin 25 at its end spaced from the holder. The number and arrangement of the welding pins on the axle 18 is adapted to the finished mat width. The surfaces of the welding pins on the side facing the wire inlet for the mats are slightly beveled or rounded.

An operating level 41 is connected to the axle 18, note FIG. 4, for turning the axle through a certain angle so that the holders 45 connected by the key to the axle can be turned and thereby moving the welding pins either into or out of engagement with the mat being formed.

Figure 6:
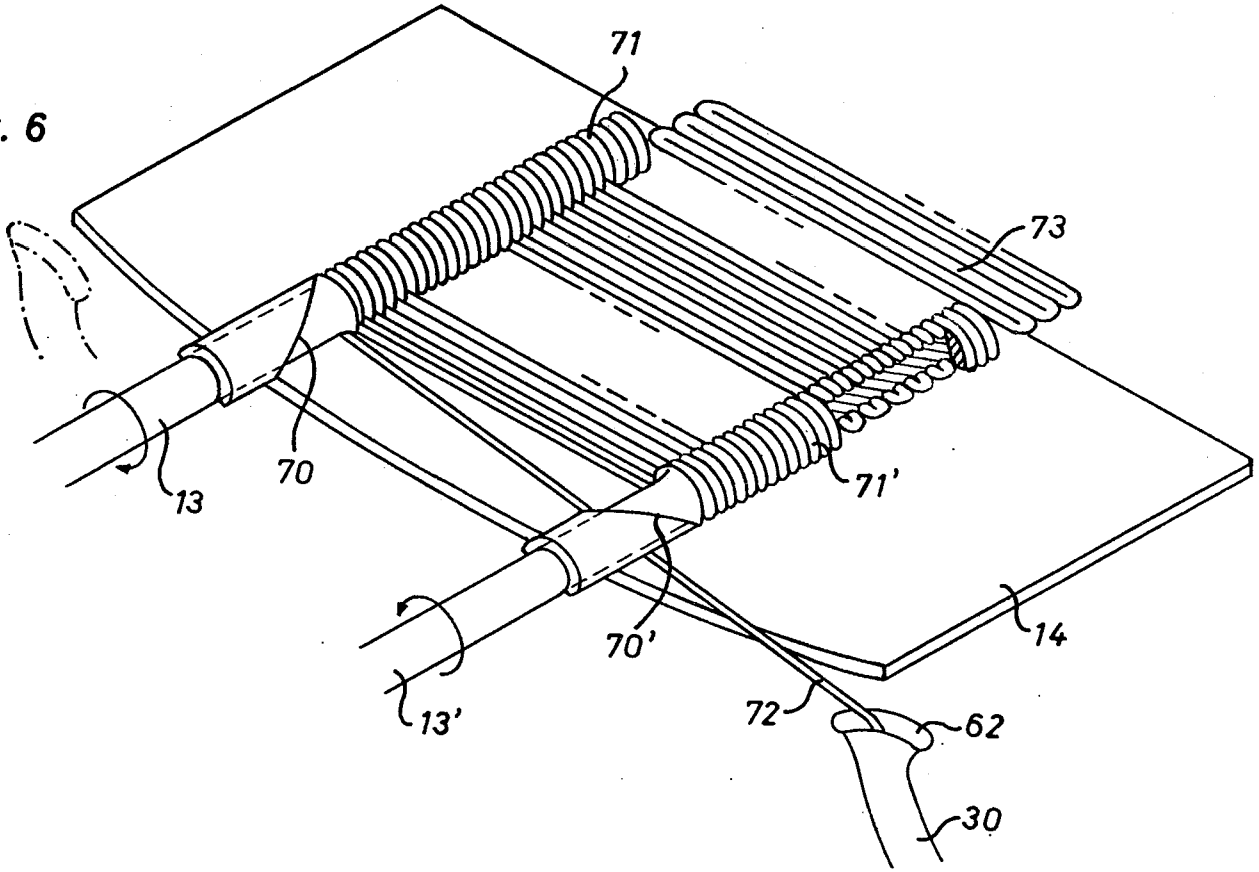
FIG. 6 is perspective view of a portion of the apparatus shown in FIGS. 1–5.

On each of the suspensions 20, 20′ spaced in the axial direction of the spindles from the bearings 17, 17′ are two spaced suspension bolts to which a winding plate 14 is secured. As can be seen in FIGS. 1 and 4 of the winding plate is positioned below the spindles 13, 13′ and its leading edge, that is the edge facing toward the left in FIG. 2, has an arc-shaped configuration. In FIG. 6 the arc-shaped configuration of the leading edge of the winding plate 14 can be noted in its position relative to the helically shaped wire guides 70 on the spindles 13, 13'. Preferably, the winding plate is spring mounted on the suspension bolts and is adjustable in height relative to the spindles so that the distance between the winding plate and the spindles can be varied. Due to this arrangement, a wire being fed between the winding plate 14 and the spindles can be held gently therebetween by the adjustable contact pressure afforded by the adjustability of the winding plate. The wire alternatively fed to one and then the other of the spindles is moved between the spindles and the winding plate by the rotation of the spindles.

Secured to the underside of the winding plate 14 in the axial range of the spindle 13, 13' is a pair of holders 22 to each of which is connected a swivel arm 23 with a bottom welding pin 25 attached to the swivel arm outwardly from the holder, note FIGS. 1 and 4. Each of the bottom welding pins 25 extend through a corresponding bore 52, note FIG. 1, to the upper surface of the winding plate 14. The bottom welding pins 25 can be turned by a mechanism, not shown, for engagement and disengagement with the mat being formed, as required.

Figure 5:
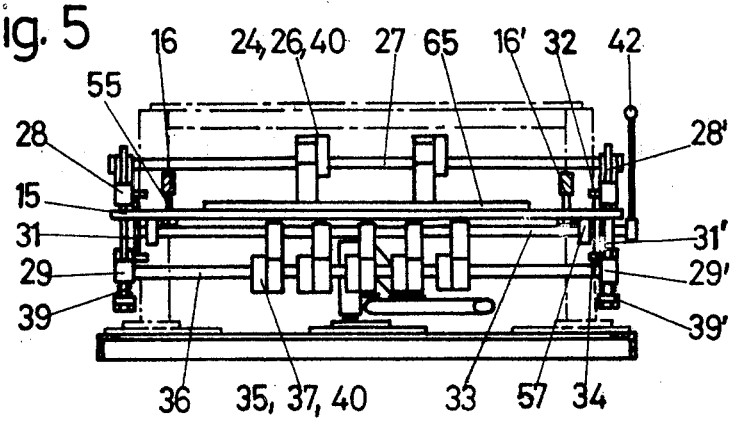
FIG. 5 is a sectional view taken along the line V—V in FIG. 1 and shown on a reduced scale.

To the right of the winding plate 14 as viewed in FIG. 1, the cantilever arms 16, 16' each support a pair of suspension bolts 55 which, in turn, support a table top-like member 15 required for afterwelding the wire mat, see FIG. 5. Below the table top-like member 15, arranged on an axle 36 having a key, not shown, are a plurality of welding pins 40 which extend upwardly through corresponding bores 53 through the table top-like member. The welding pins are each supported on a swivel arm 37 attached to a holder 35 positioned on the axle for adjustment in the axial direction thereof. The welding pins supported on the axle are adapted in number and arrangement to the front top welding pins 25 mounted on the axle 18.

As can be seen in FIG. 5, the axle 36 is mounted at its ends into axle bearings 29, 29' which are elastically suspended on two bolts 39, 39' provided with springs 54. The bolts extend through bores provided in the table top-like member and are rigidly connected with the member by means not shown.

Corresponding to the axle bearings 29, 29', located above the table top-like member 15, are two axle bearing 28, 28' also held in place by the bolts 39, 39' and the springs 54. An axle 27 extends between and is supported by the axle bearings 28, 28' and the axle supports a pair of holders 26 for the top welding pins 40. A swivel arm 24 extends from each of the holders 26 to the corresponding welding pin 40. The top welding pins 40 correspond to the front bottom welding pins 25.

The axle bearings 28, 28' and 29, 29' located above and below the table top-like member 15 are held under spring tension by the spring 54. As can be seen in FIG. 5, eccentric bolts 32 are secured to the inner sides of the bearings 28, 28' and eccentric bolts 34 are secured to the inner sides of the bearings 29, 29' and extending between the eccentric bolts on each side of the apparatus is a substantially elliptic eccentric disc 31, 31' with slots 56 provided in the table top-like member so that the discs can extend therethrough. In the outer periphery of the eccentric discs 31, 31' there are provided recesses 58 which serve as notches to receive the respective eccentric bolts 32, 34. An axle 33 operatively connects the spaced eccentric discs 31, 31' together and is mounted in bearings 57 secured to the table top-like member 15. An operating level is secured to the axle 33 so that the axle can be turned through a certain angle whereby the eccentric discs 31, 31' are also turned and at the same time the upper and lower axle bearings 28, 28' and 29, 29', respectively, guided by the bolts 39. 39' are pressed upwardly and downwardly by the spring force for effecting the engagement and disengagement of the welding pins mounted on the upper and lower axles 27, 37, note FIGS. 1 and 5.

On the righthand end of the frame 1, as viewed in FIG. 2, a plate 59 is rigidly connected to the frame with a pivot bearing 38, not shown in detail, mounted on the plate. At one of its ends, an arm or wire feed member 30 is secured to the bearing 38 so that it can be swung in a horizontal arc about the center 67 of the bearing. The wire feed member 30 extends from the bearing 38 in the leftward direction, as viewed in FIGS. 1 and 2, below the table top-like member 15 and the winding plate 14 with its opposite end located between the arc-shaped edge of the winding plate 14 and the adjacent surface of the supporting frame 4. At its free end, the arm or wire feed member 30 has an upwardly bend end 60 which can be swung into position immediately below the spindles 13, 13'.

At its end located on the pivot bearing 38, the feed wire member 30 has an inlet 61 and at its opposite end, between the winding plate 14 and the supporting frame 4, it has an outlet 62. The member 30 is preferably tubular in shape for conducting the wire 72 to be used in forming a mat. The wire is unwound from a roll, not shown, and maintains tension by a wire brake 50 shown schematically on the plate 59. The inlet and outlet openings to the wire feed member 30 are designed for proper guidance and deflection of the wire, for example, by slightly compressing the end of the member so that it forms a substantially elliptic funnel, as can be seen from the top in FIG. 6.

Closely spaced from its end connected to the pivot bearing 38, the feed wire member 30 is attached to a connecting rod 46 which extends laterally outwardly and is attached to an eccentric disc 47 mounted on one of the long sides of the frame 1. The eccentric disc 47 is operatively connected with a motor 48 driven by a program transmitter 39. The wire feed member 30 can also be driven hydraulically or pneumatically, for example, by double pistons and magnetic anticipatory control and program cylinders. The disc 47, motor 48 and program transmitter 49 are secured on the frame 1 by means which are not shown.

On the table top-like member 15 directly adjoining the winding plate 14 is secured a mat guide 65 provided with spaced fingers extending substantially to the ends of the spindles 13, 13', however, it is preferable if the fingers extend over the winding plate 14 to its arc-shaped leading edge, so that tilting of the closely arranged wires, which are subsequently to be welded into a mat 73, is avoided. Additionally, two guide holders 64 provided with oblong slots, not shown, are secured on the table top-like member 15 and two guide rails are secured to the guide holders to afford lateral guidance for the mat. The guide rails 63 can be adjusted to correspond to the finished mat width.

On the top side of the supporting frame 4 as well as at the end of the table top-like member 15 there are provided coupling carriers 43, 44 in which plug couplings, not shown, are arranged for connecting cables supplying the welding pins 25, 50 with the requisite electrical energy.

The method of operation of the above described apparatus is as follows:

The wire 72 used for forming a mat is unwound from a roll, not shown, and introduced into the feed wire member at the inlet 61. The wire passes through the tubular shaped feed wire member or arm 30, exiting at the outlet 62, from where it passes alternately to one of the spindles 13, 13′, due to the control afforded by the connecting rod 46, the eccentric disc 47, and the motor 48 which are controlled by the program transmitter 49. The program transmitter 49 cooperates with the program transmitters 9, 9′ which generate the impulses for starting the motors 10, 10′ and driving the spindles 13, 13′.

The cooperation of the outlet 62 of the feed wire member 30 with the spindles 13, 13′ in the formation of a wire mat 73 can best be explained with reference to FIG. 6. As can be seen in FIG. 6, the outlet 62 can be moved or pivoted about the bearing 38 between two positions each adjacent an opposite side of the winding plate 14. One of the positions of the outlet 62 is shown in full line while the other position is shown in dot-dash lines. As soon as the outlet 62 of the wire feed member 30 arrives at one of its end or reversing points, the spindles 13, 13′ are set in motion in opposite directions. Due to the rotation of the spindles, the wire is guided by the helical wired guide 70, 70′ to the adjacent end of the screw threads 71, 71′ and is held by the screw threads. The wire guide 70 extends only for 180° around the spindle so that there is sufficient space between the spindle and the table for the insertion of the wire, with the wire being moved over the table into the screw threads as the wire guide rotates. As the spindle rotates through the first 90° of each full revolution the wire is not moved. However, during the next 180° of movement the wire guide 70 moves the wire over the winding plate toward the adjacent end of the screw threads. During the final 90° of revolution of the spindle the wire is placed into the first turn of the threads in the screw thread on the spindle. With the pitch of the screw threads corresponding to the wire diameter, the wire sections formed lie alongside one another.

After the wire is seated into the first turn of the screw threads, the wire feed means 30 is pivoted for instance, from the full line position shown in FIG. 6 to the dot-dash line position shown and, during the pivoting movement, the spindles 13, 13′ do not rotate. When the outlet 62 has reached the dot-dash position the wire has been folded over relative to the previous section applied and the spindles again turn in the opposite directions and an additional wire section is moved by the wire guides into the first turn of the screw threads with the previous wire sections being moved in the rightward direction as viewed in FIGS. 1, 2 and 6. The oscillating movement of the wire feed means 30 moves the outlet 62 back and forth between the two positions shown in FIG. 6 and when each end position is reached the spindles 13, 13′ are rotated to provide the folding and feeding action.

To assure that the wire moves without any difficulty to the first turns of the screw thread 71, 71′, the wire guides 70, 70′ extend only over half of the spindle circumference, as mentioned above. Depending on the position of the outlet 62, one of the two wire guides direct the wire 72 to the first turn on the corresponding screw thread 71, 71′ while at the other spindle the first flank of the screw thread effects the feeding of the wire section away from the wire guide. Accordingly, alternating wire sections are laid with little interval between the winding plate 14 and the superposed spindles 13, 13′ and the mat 73 is formed in a continuous manner. As the mat is being formed adjacent wire sections are joined with one another from the top and bottom by the welding pins 25, 40.

The above-described apparatus is suitable for the manufacture of wire mats which have different mat widths and for this purpose the spindles and their respective driving units, the welding pins and also the oscillating range of the wire feed member or arm can be adapted to each other corresponding to the finished mat width.

While specific embodiments of the invention have been shown and described in detail to illustrate the application of the inventive principles, it will be understood that this invention may be embodied otherwise without departing from such principles.

What is claimed is:

1. Apparatus for the manufacture of mats from a continuous wire, such as a plastic-coated wire, with the wire being folded back and forth into juxtaposed wire sections joined by return bends at the opposite ends of each wire section, comprising a winding plate having a first surface and an oppositely facing second surface with a leading edge along one side and a trailing edge along the opposite side thereof, a pair of laterally spaced substantially parallel spindles located opposite and adjacent to the first surface of said plate, the axes of said spindles being substantially parallel to the first surface of said winding plate and extending in the direction between said leading and trailing edges, a wire feed member located opposite the second surface of said winding plate, said winding feed member having a wire outlet located adjacent the leading edge of said winding plate and a wire inlet spaced from said wire outlet in the direction extending from the leading edge toward the trailing edge of said winding plate, means supporting said wire feed member for swinging said member in an arc extending transversely of the direction extending between the leading edge and trailing edge so that the wire outlet can be displaced in a path extending generally along the leading edge of said winding plate, each said spindle having a helically shaped wire guide located adjacent the leading edge of said winding plate and a screw thread extending from said wire guide in the direction toward the trailing edge of said winding plate, means for rotating each of said spindles in an opposite direction to the direction of rotation of the other said spindle, each said screw thread having a pitch corresponding substantially to the wire diameter of the mat to be formed and each said helically shaped wire guide having a pitch significantly greater than the pitch of said screw thread.

2. Apparatus, as set forth in claim 1, wherein said screw threads have a semicircular configuration in an axially extending section through said spindle.

3. Apparatus, as set forth in claim 1, wherein the leading edge of said winding plate has an arc-shaped configuration bowing outwardly away from said trailing edge.

4. Apparatus, as set forth in claim 1, including means for adjustably positioning said winding plate relative to said spindles.

5. Apparatus, as set forth in claim 4, wherein said means for adjustably positioning said winding plate includes resilient biasing means for elastically supporting said winding plate relative to said spindles.

6. Apparatus, as set forth in claim 4, wherein a horizontal frame supports said spindle and winding plate horizontally with the first and second surface of said winding plate arranged horizontally, a vertical support secured to and extending upwardly from said frame and spaced from said winding plate and positioned on the leading edge side of said winding plate, cantilever arms secured to and extending horizontally from said vertical support, a horizontally arranged table top-like support member having one edge thereof adjacent the trailing edge of said winding plate and extending away from said winding plate with the upper surface of said support member being in the same substantially horizontal plane as the first surface of said winding plate, said table top-like support member being supported from said cantilever arms, said means for adjustably positioning said winding plate supported from said cantilever arms, and electrically operated welding pins located above and below said winding plate and said table top-like support members.

7. Apparatus, as set forth in claim 6, wherein said welding pins are adjustable in the direction perpendicular to the first surface of said winding plate.

8. Apparatus, as set forth in claim 7, wherein means are connected to each said welding pin for moving said welding pins between a first position where welding can be effected on the mat being formed and a second position where said welding pins are spaced from the first position and from the mat being formed so that no welding operation can be effected on the mat, said means comprising for each said welding pin, a holder arranged to be attached to a support and a swivel arm connecting said welding pin to said holder for moving said welding pin.

9. Apparatus, as set forth in claim 1, wherein mat guides are positioned adjacent the first surfaces of said winding plate, said mat guides extending toward said spindle from a location on the opposite side of the trailing edge of said winding plate from the leading edge thereof, said spindles each having a leading end spaced at the opposite side of the leading edge of said winding plate from the trailing edge thereof and a trailing end spaced axially from the leading end in the same relative direction as between the leading and trailing edges of said winding plate, and said mat guides each having a first end spaced on the opposite side of the trailing edge of said winding plate from the leading edge thereof, and a second end located at least adjacent to the trailing ends of said spindles.

10. Apparatus, as set forth in claim 9, wherein the second ends of said mat guides are located adjacent the leading edges of said winding plate.

11. Apparatus, as set forth in claim 1, wherein said means supporting said wire feed member includes a motor driven eccentric disc positioned laterally outwardly from said wire feed member, and a connecting rod attached to said disc and to said wire feed member at a position intermediate its wire inlet and wire outlet.

12. Apparatus, as set forth in claim 11, wherein the point of attachment of said connecting rod to said disc is adjustable.

13. Apparatus, as set forth in claim 11, wherein a frame supports said spindles and winding plate horizontally, said frame including a support plate spaced on the opposite side of the trailing edge of said winding plate from the leading edge thereof, a privotal bearing having a vertical pivot axis mounted on said support plate, said wire feed member being tubular and extending horizontally below the second surface of said winding plate, said connecting rod extending horizontally from said eccentric disc to said wire feed member for providing an oscillating swinging movement to said wire feed member about the vertical pivot axis of said pivotal bearing.

14. Apparatus, as set forth in claim 13, wherein said wire outlet extends vertically upwardly from the horizontally extending section of said wire feed member located below said winding plate and said wire outlet has an opening located at the level of said first surface of said winding plate, the opening of said wire outlet being flattened into an elliptical shape.

15. Apparatus, as set forth in claim 1, wherein a horizontal frame supports said spindle and winding plate horizontally with the first and second surfaces of said winding plate arranged horizontally, a vertical support secured to and extending upwardly from said frame, said vertical support located adjacent to and on the opposite side of the leading edge of said winding plate from said trailing edge thereof, a motor plate for each said spindle secured to said vertical support and extending from said vertical support in the direction opposite to said winding plate, a motor mounted on each said motor plate, a pair of spaced bearing blocks mounted on each said motor plate between said motor and said winding plate, one of said spindles being supported in each said pair of bearing blocks, a coupling connecting each said spindle to the corresponding said motor, and means for adjusting said motor and said coupling relative to said spindles.

* * * * *